US006818848B2

(12) United States Patent
Yu

(10) Patent No.: US 6,818,848 B2
(45) Date of Patent: Nov. 16, 2004

(54) PUSHBUTTON ASSEMBLY WITH POSITIONING ROD AND DISK

(76) Inventor: Tsung-Mou Yu, No. 4, Alley 2, Lane 23, Sec. 3, Pa Te Rd., Panchiao City, Taipei Hsien (TW)

( * ) Notice: Subject to any disclaimer, the term of this patent is extended or adjusted under 35 U.S.C. 154(b) by 0 days.

(21) Appl. No.: 10/357,654

(22) Filed: Feb. 3, 2003

(65) Prior Publication Data

US 2004/0149562 A1 Aug. 5, 2004

(51) Int. Cl.[7] ..... H01H 13/56
(52) U.S. Cl. ..... 200/523
(58) Field of Search ..... 200/523, 525, 200/524

(56) References Cited

U.S. PATENT DOCUMENTS

| | | | | | |
|---|---|---|---|---|---|
| 3,172,296 | A | * | 3/1965 | Tancred | 200/523 |
| 4,003,010 | A | * | 1/1977 | Kuchuris et al. | 200/525 |
| 4,167,720 | A | | 9/1979 | Krasser | 337/60 |
| 4,273,980 | A | * | 6/1981 | Rogero | 200/524 |
| 4,352,967 | A | * | 10/1982 | Buchtel | 200/525 |
| 4,668,847 | A | * | 5/1987 | Greene | 200/524 |
| 4,937,548 | A | | 6/1990 | Sdunek | 337/70 |
| 5,233,813 | A | | 8/1993 | Kenney et al. | 53/450 |
| 5,451,729 | A | | 9/1995 | Onderka et al. | 200/18 |
| 5,558,211 | A | | 9/1996 | Heydner et al. | 200/553 |
| 6,420,670 | B1 | * | 7/2002 | Yu | 200/524 |

FOREIGN PATENT DOCUMENTS

| | | | | |
|---|---|---|---|---|
| DE | 31 40732 A1 | * | 4/1983 | 200/523 |

* cited by examiner

*Primary Examiner*—Renee Luebke

(57) ABSTRACT

A pushbutton assembly includes a housing and a button slidable with respect to the housing. A passage is formed in the housing which is provided with a projection formed in the passage and a slanted face on top of the projection. A positioning disk is pivotally connected to the projection and has a positioning hole. A positioning rod is pivotally connected to the button and has a bent received in the positioning hole of the positioning disk in such a way that movement of the button drives the bent to reciprocally move from a first position to a second position.

18 Claims, 13 Drawing Sheets

PUSHBUTTON ASSEMBLY WITH POSITIONING ROD AND DISK

FIELD OF THE INVENTION

The present invention relates to a pushbutton assembly, and more particularly to a pushbutton assembly having a positioning rod rotatably connected to a button and a positioning disk pivotally received in a housing of the pushbutton assembly and having a positioning hole defined in the positioning disk to receive therein a bent of the positioning rod such that repeated up and down movement of the button allows the bent to be positioned at a first position and a second position within the positioning hole to accomplish the designed purpose of the pushbutton assembly.

BACKGROUND OF THE INVENTION

With reference to FIGS. 1 to 3, a conventional pushbutton assembly is applied in a ball point pen. The ball point pen has a barrel 403, a button 406, a cap 404, a first sleeve 407 and a second sleeve 409. The barrel 403 is provided with a spring 402 and a core 401 received in the barrel 403. The cap 404 has positioning slots 405 defined in an inner periphery of the cap 404 and bars 4051 each alternately formed between, two adjacent positioning slots 405. Each bar 4051 has an inclined top face.

The first sleeve 407 has first bosses 408 formed around an outer periphery of the first sleeve 407 to correspond to the positioning slots 405 of the cap 404. The second sleeve 409 has second bosses 410 formed on an outer periphery of the second sleeve 409 to correspond to the positioning slots 405 of the cap 404. After the cap 404 is assembled with the barrel 403, the button 406 and the first sleeve 407 are slidable relative to the barrel 404. After the assembly of the pen, the user pushes the button 406, the downward movement of the first sleeve 407 drives the second sleeve 409 to rotate, allowing the second bosses 410 to about the top face of the bar 4051 to extend the core 401 out of the barrel, as shown in FIG. 2. However, when the user pushes the button 406 again, the second bosses 410 are thus received in the corresponding positioning slots 405, allowing the core 401 to be retracted in the barrel 403, as shown in FIG. 3. In this type of pushbutton assembly, parts are loosely connected to one another. Thus, every movement of the button 406 creates a lot of friction between parts and that wears out the engaged faces of the parts. From the foregoing description, it is noted that this type of conventional pushbutton assembly not suitable for sophisticated electronic components.

U.S. Pat. No. 4,167,720; U.S. Pat. No. 4,937,548; U.S. Pat. No. 5,223,813 U.S. Pat. No. 5,451,729; U.S. Pat. No. 5,558,211 are numerous patents related to a pushbutton assembly, which all suffer from the following shortcomings:

1. Too many linking parts are involved in a single movement, causing a complex process to accomplish a single purpose and a non-real-time action; and
2. Because the quantity of the parts to accomplish a single action is large, possibility of malfunction is great and the quality of coupling between parts is low.

With reference to FIG. 4, a second conventional pushbutton assembly is shown to have a button 501 and a housing 506.

The button 501 is mounted on top of a body (not numbered) having a V-shaped protrusion 503 which is formed on a bottom of a channel 502 and has a lowermost point (a). The channel 502 has a lowermost point (b). A positioning rod 504 has a first end inserted into the through hole 507 in the housing 506 and a second end 505 extending into the channel 502. A spring 508 is employed to provide a resilience to the button 501 and to ensure that the second end of the positioning rod 502 to abut an inner face of the channel 502.

When the user presses the button 501, the second end of the positioning rod 504 moves from point (a) to point (b). When the user pushes the button 501 again, the second end of the positioning rod 504 moves from point (b) to point (a). After the pushbutton assembly is used for a period of time, the resilience of the spring 508 is deteriorated, and the engagement of the second end 505 of the positioning rod 504 with the inner face of the channel 502 is not secured. Therefore, it is noted that the second end 505 of the positioning rod 504 may deviate from point (a) if the resilience form the spring 508 is not enough. Another shortcoming from the insufficient resilience is that the contact 510 of the electrical plate 509 may not engage with the contact 512 of the pin 511 properly and thus causes malfunction.

Accordingly, the conventional pushbutton assembly uses too many parts so that the cost is high and the possibility of having malfunction is thus high.

To overcome the shortcomings, the present invention tends to provide an improved pushbutton assembly to solve the aforementioned problems.

SUMMARY OF THE INVENTION

The primary objective of the present invention is to provide an improved pushbutton assembly having a positioning rod rotatably connected to a button and a positioning disk pivotally received in a housing of the pushbutton assembly and having a positioning hole defined in the positioning disk to receive therein a bent of the positioning rod such that repeated up and down movement of the button allows the bent to be positioned at a first position and a second position within the positioning hole to accomplish the designed purpose of the pushbutton assembly.

Other objects, advantages and novel features of the invention will become more apparent from the following detailed description when taken in conjunction with the accompanying drawings.

DETAILED DESCRIPTION OF THE INVENTION

Figure 1:
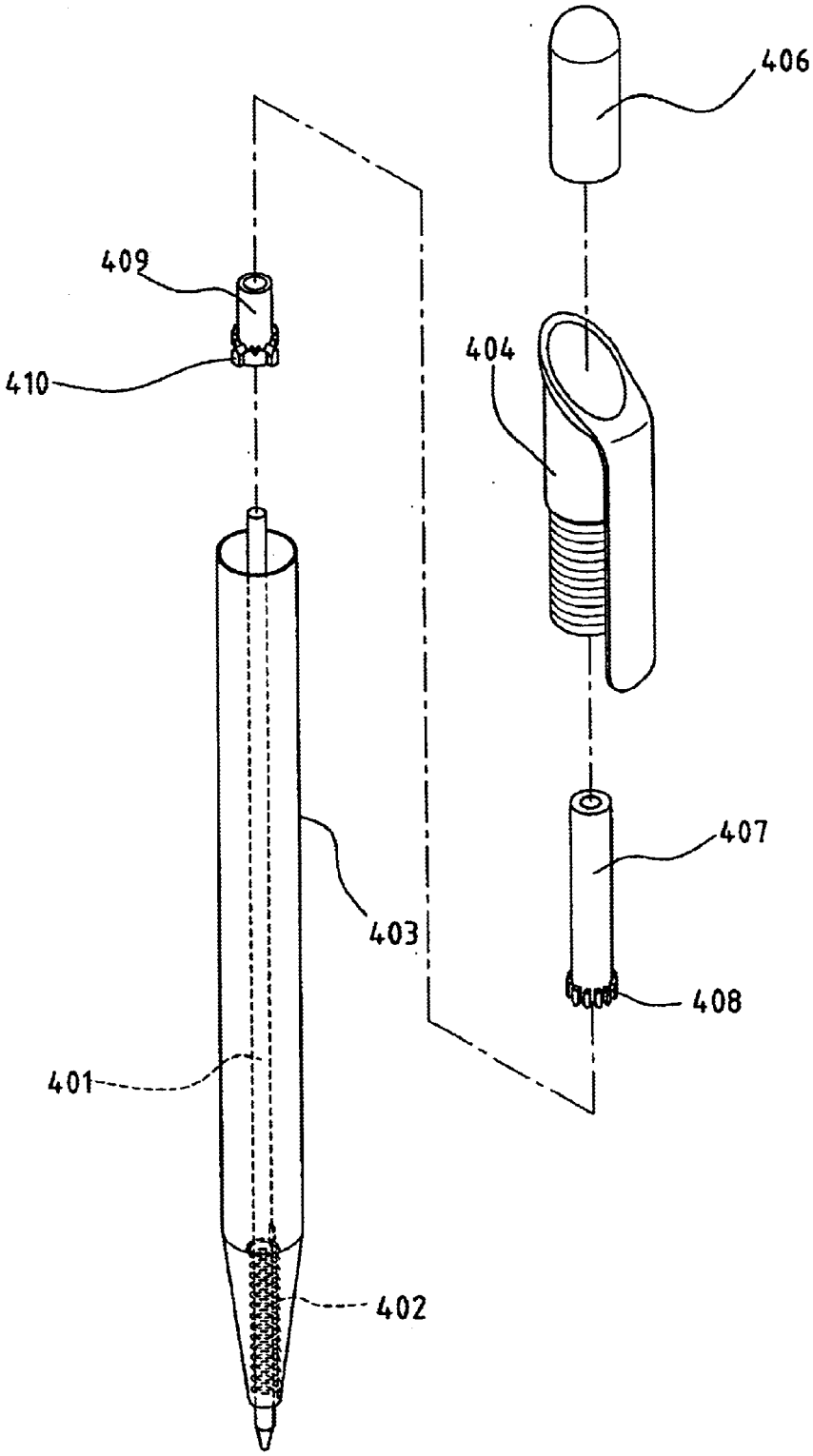
FIG. 1 (PRIOR ART)
FIG. 1 is an exploded perspective view of a conventional pushbutton assembly used in a ball point pen.
Figure 2:
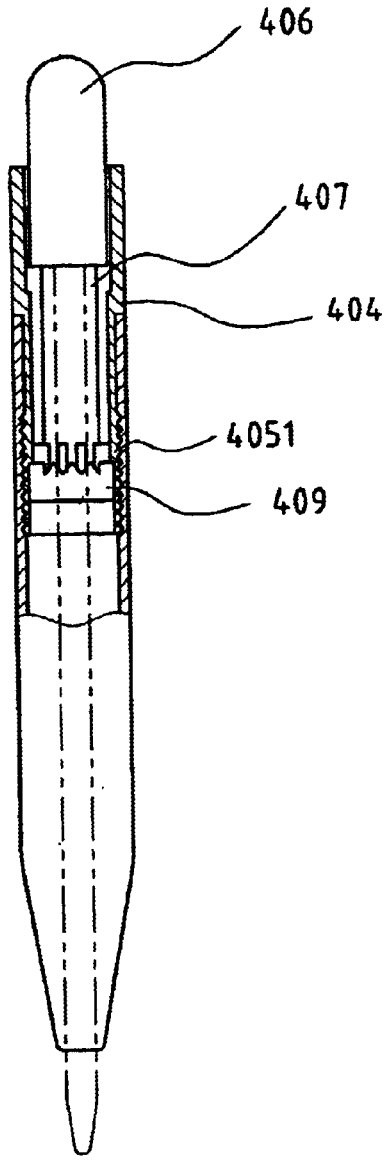
FIG. 2 (PRIOR ART)
FIG. 2 is a schematic view showing that the core extends out of the barrel by the pushbutton assembly in FIG. 1.
Figure 3:
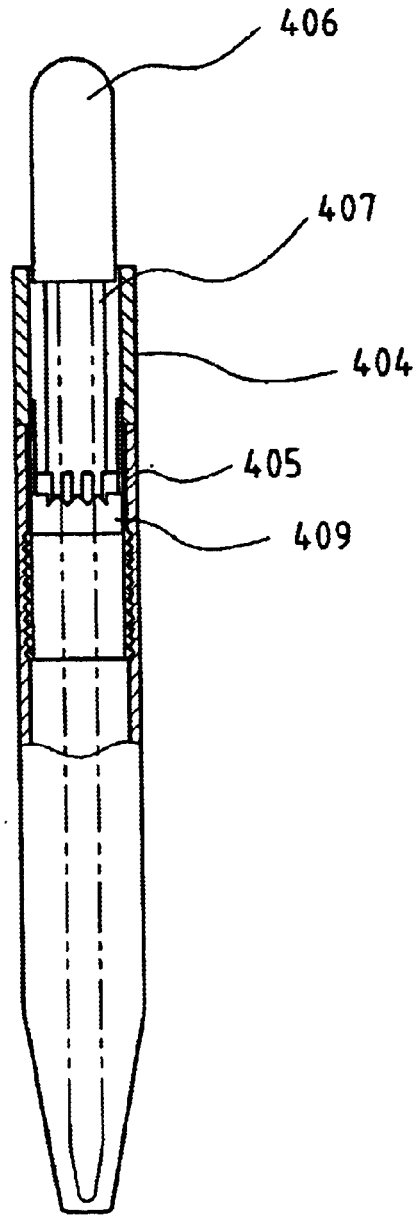
FIG. 3 (PRIOR ART)
FIG. 3 is a schematic view showing that the core is retracted in the barrel by the pushbutton assembly in FIG. 1.
Figure 4:
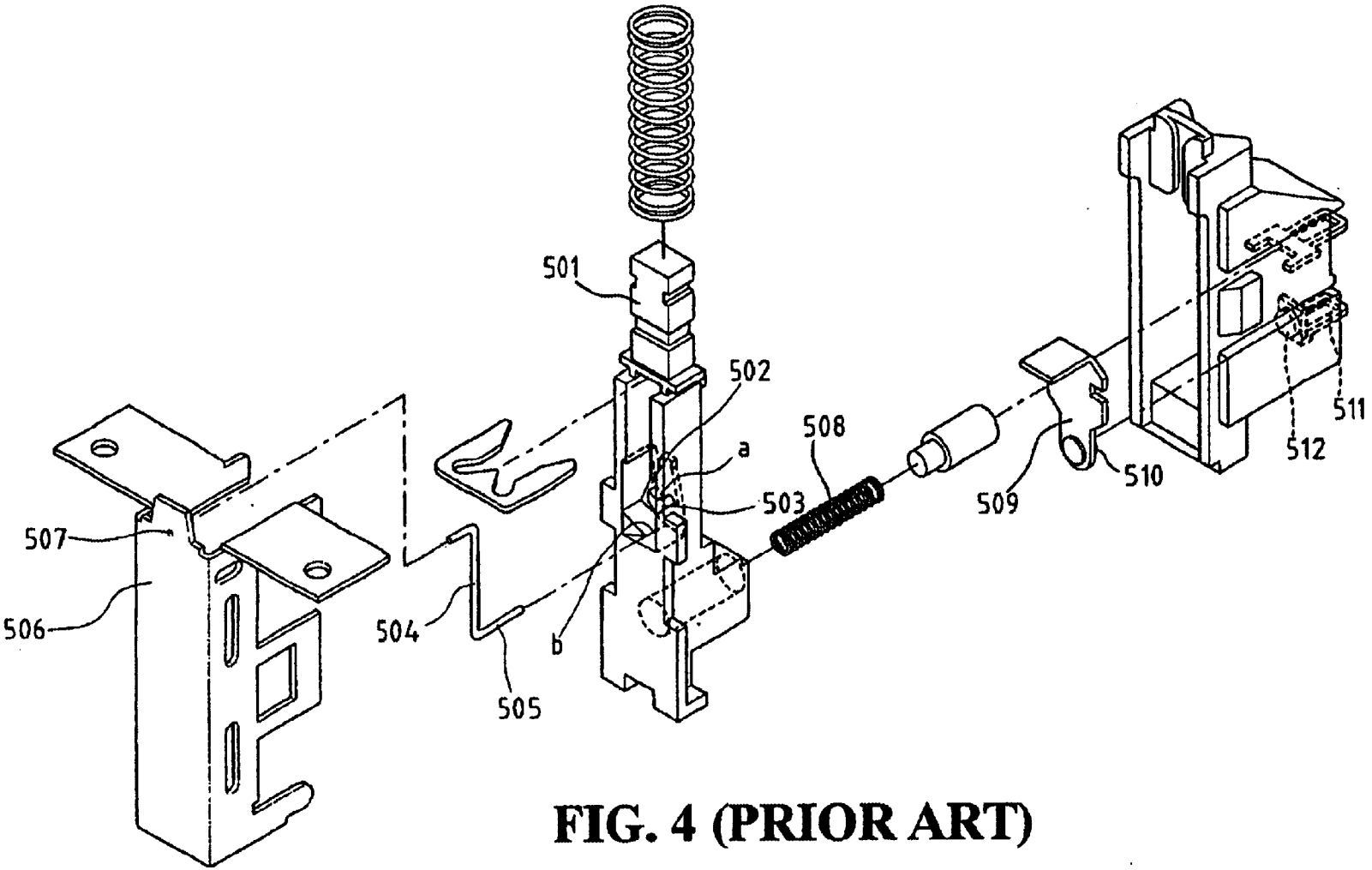
FIG. 4 (PRIOR ART)
FIG. 4 is an exploded perspective view of a conventional pushbutton assembly used in an electronic device.
Figure 5:
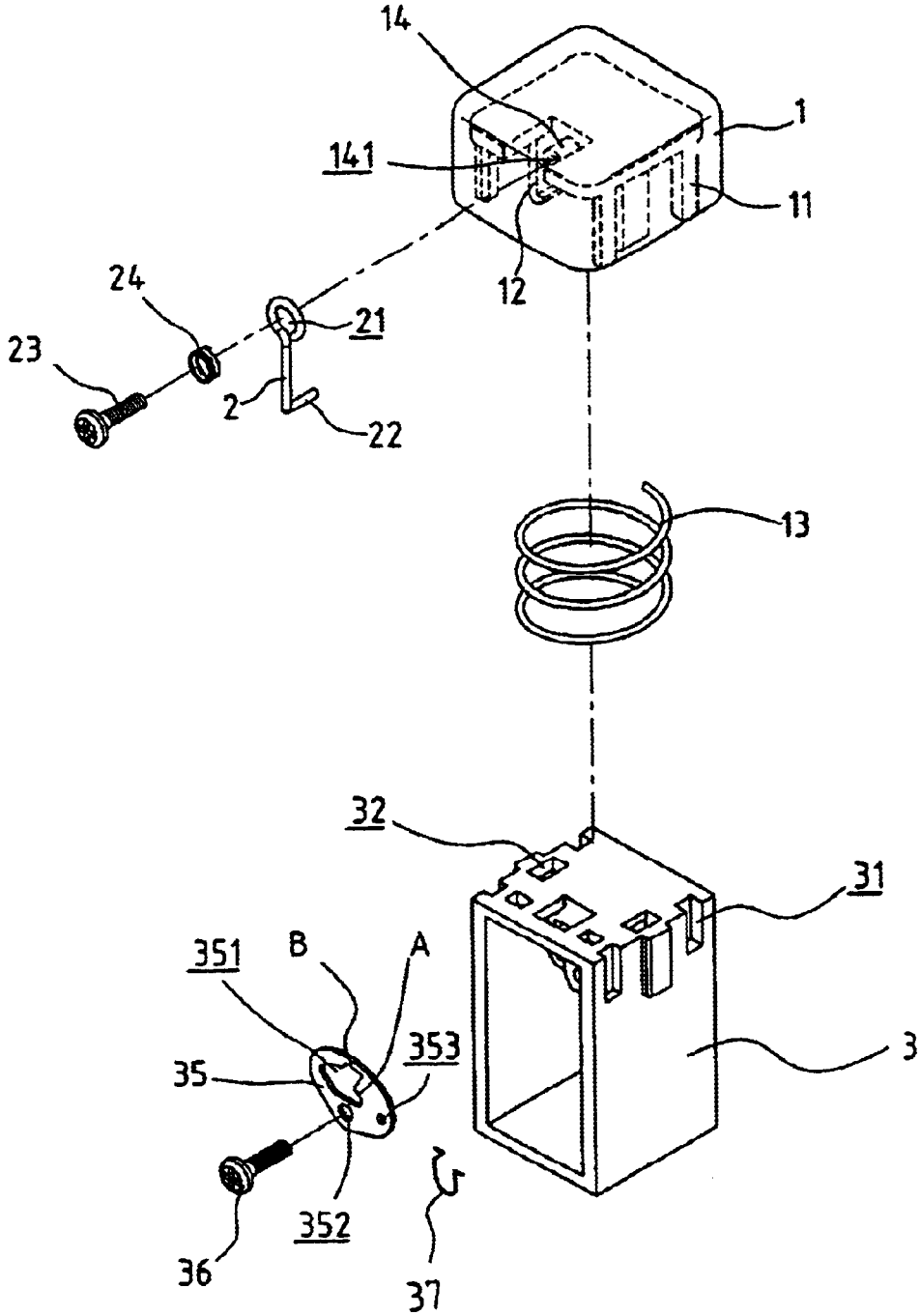
FIG. 5 is an exploded perspective view of the pushbutton assembly of the present invention.
Figure 6:
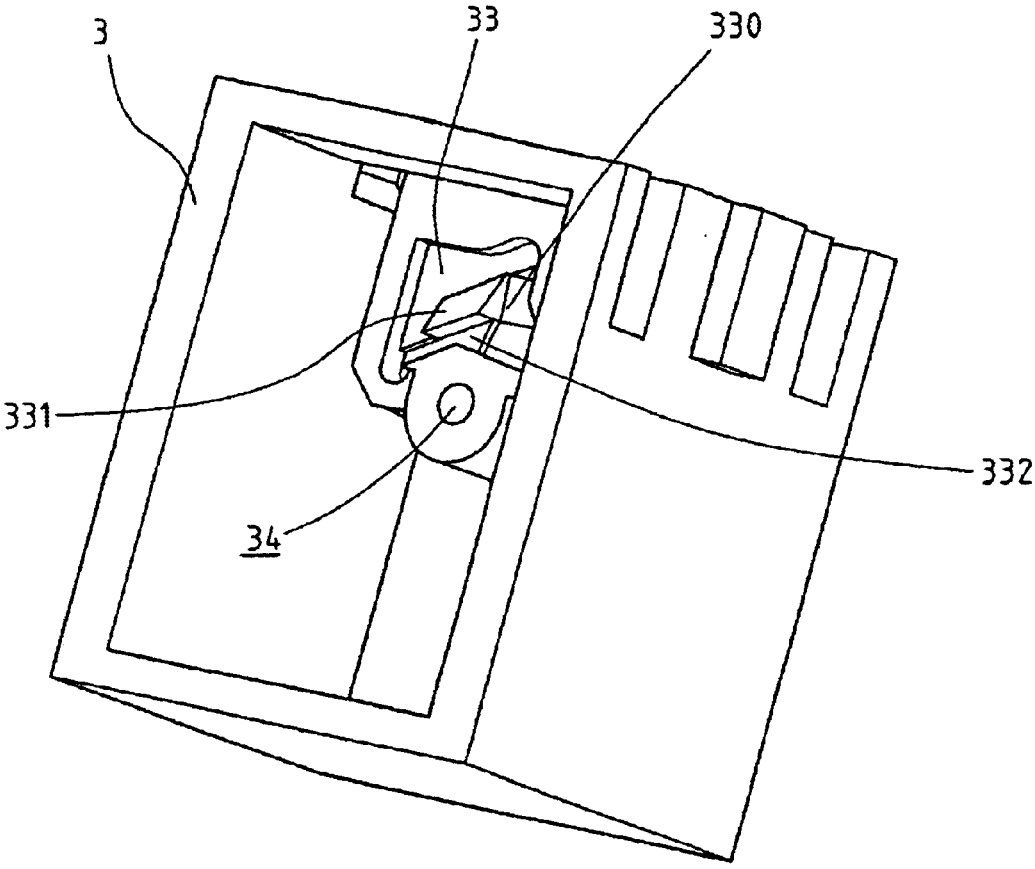
FIG. 6 is a perspective view of the housing of the pushbutton assembly, wherein in order to show the inner structure of the housing, the view is slightly slanted.

With reference to FIGS. 5 and 6, the pushbutton assembly of the present invention includes a button 1, a positioning rod 2 and a housing 3.

The button 1 has extensions 11 integrally formed on a bottom face of the button 1. A positioning hook 12 extends from the bottom face of the button 1. A first resilient element 13 (preferably a spring) is received in the button 1 and an assembly rod 14 is formed on a side face of the button 1 and has an assembly hole 141.

The positioning rod 2 has a through hole 21 defined in a first distal end of the positioning rod 2 and a bent 22 integrally formed on a second distal end of the positioning rod 2. A first bolt 23 is provided to extend through a second resilient element 24, the through hole 21 of the positioning rod 2 and the assembly hole 141 of the assembly rod 14.

Figure 7:
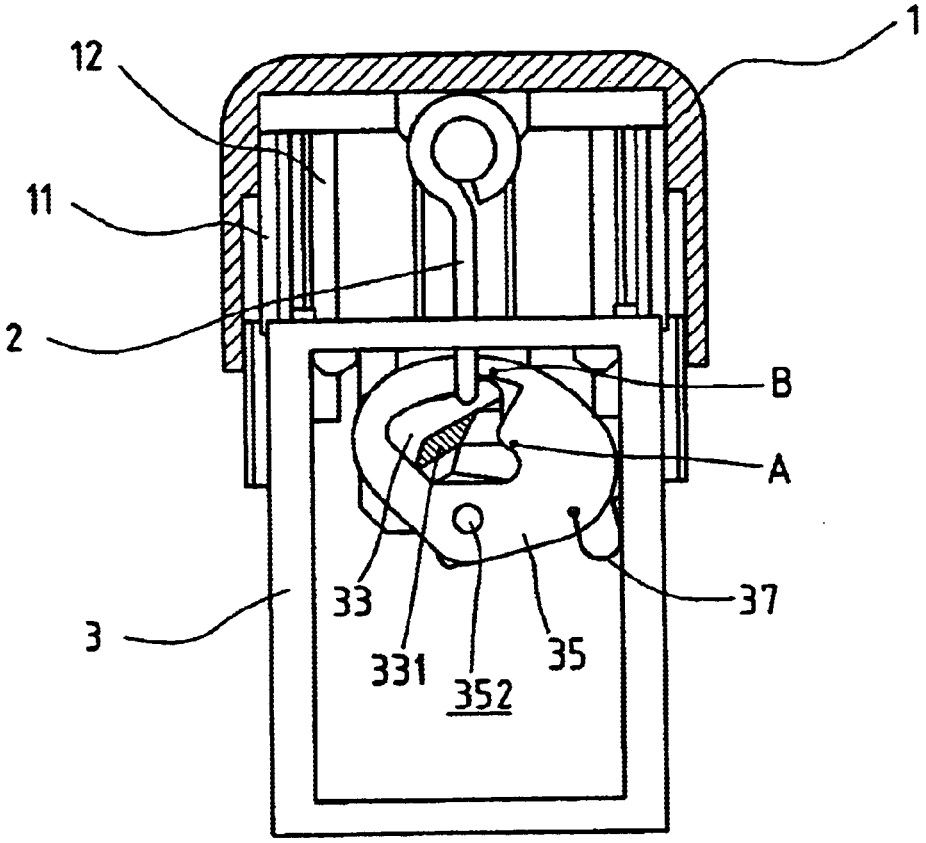
FIG. 7 is a schematic view showing that the button is not pressed.

The housing 3 has cutouts 31 defined in an outer face of the housing 3 to correspond to the extensions 11 at least one hole 32 defined to correspond to the positioning hook 12, a passage 33 defined in the housing 3 and having a projection 330 with a slanted face 331, an assembly slot 34 in the housing 3 and a positioning disk 35 pivotally connected to the housing 3 and having a positioning hole 351, a first hole 352 defined to correspond to a second bolt 36 and the assembly slot 34 and a second hole 353 defined to correspond to a distal end of a third resilient element 37. As can be seen in FIGS. 5 and 7, the positioning hole 351 is formed through the positioning disk 35 which is positioned and assembled in front of the passage 33 and the bent 22 is disposed in the passage 33 through the positioning hole 351.

Figure 8:
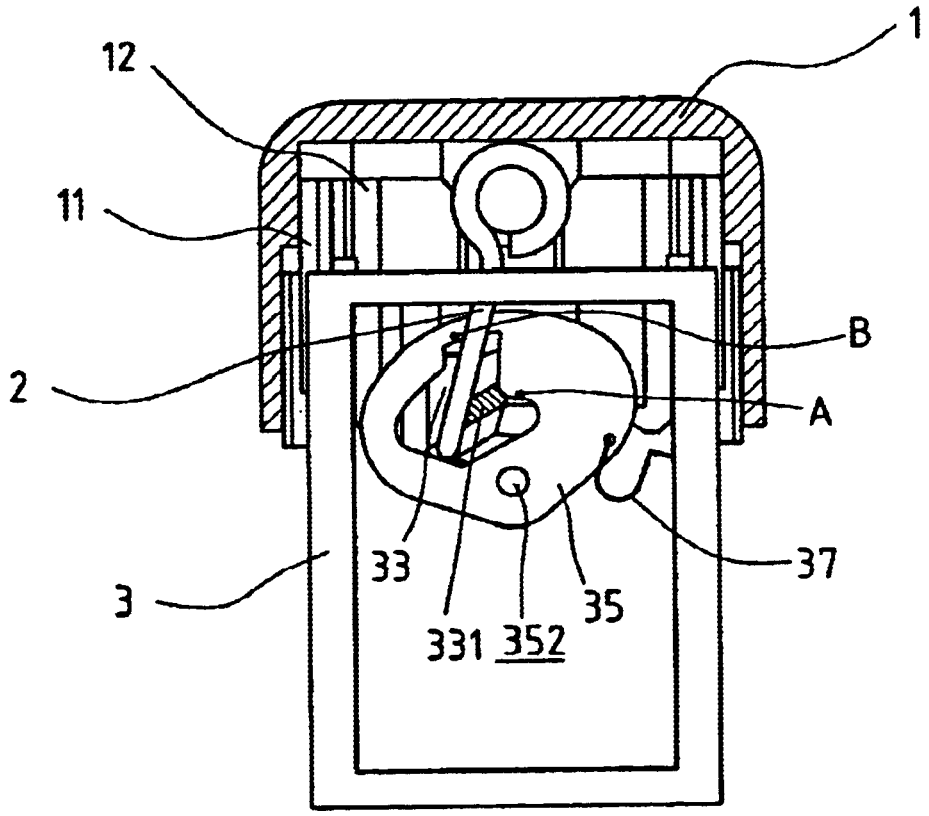
FIG. 8 is a schematic view showing that the downward movement of the button forces the positioning rod to move and the positioning disk to pivot.
Figure 9:
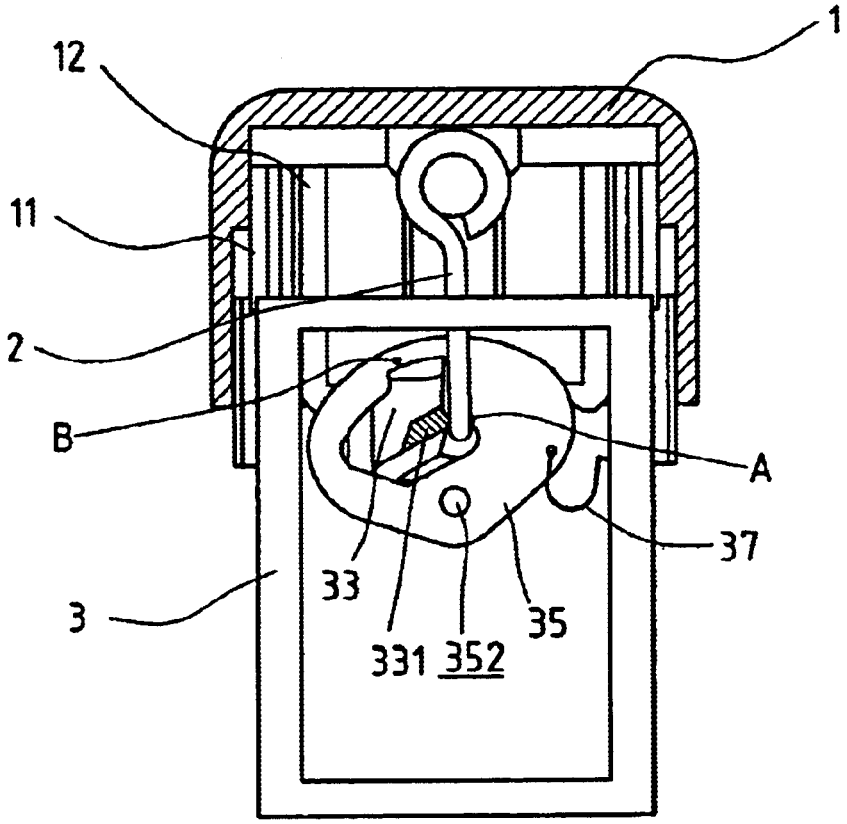
FIG. 9 is a schematic view showing that the button is pressed and secured.

With reference to FIGS. 5–7 when the pushbutton assembly of the present invention is assembled, the first resilient element 13 is first received in the button 1 and the positioning rod 2 is pivotally connected to the button 1 by the first bolt 23 with the bent 22 extending downward relative to the button 1. Then the extensions 11 extend into the cutouts 31 and the positioning hook 12 extends into the corresponding hole 32 to secure the connection between the housing 3 and the button 1. After the positioning disk 35 is pivotally connected to the housing 3 by the second bolt 36 which extends through the first hole 352 and the assembly slot 34, the positioning disk 35 is able to pivot using the second bolt 36 as the central axis. It is noted from the drawings that the bent 22 of the positioning rod 2 extends into the positioning hole 351 and one distal end of the third resilient element 37 extends into the second hole 353 of the positioning disk 35 and the other distal end of the third resilient element 37 securely abuts an inner face of the housing 3. Therefore, it is noted that the positioning disk 35 is urged by the third resilient element 37 to be maintained in a position When the button 1 is not pressed, as shown in FIG. 7, the button 1 extends out of the housing 3. When the button 1 is pressed, the positioning rod 2 is driven to move accordingly. With reference to FIG. 6, it should be noted that below the slanted face 331 of the projection 330 is a recessed channel 332 which can not be easily shown and is not labelled on FIGS. 7–10. The bent 22 slides over the slanted face 331 in the passage 33, which allows the bent 22 to move leftward (from the viewer's direction) to abut a side face defining the positioning hole 351 so that the positioning disk 35 pivots to the left, as shown in FIG. 8. As the positioning disk 35 pivots to the left and the positioning rod 2 moves downwards, the bent 22 slides into the recessed channel 332. If the user releases the button 1, the bent 22 rests in the recessed channel 332 and is prevented from moving above point (A) in the positioning hole 351 because the area near point (A) of the positioning disk 35 and the slanted face 331 have blocked the upward passage as can be seen from FIG. 9. Therefore, the button 1 is at a second (depressed) position, as shown in FIG. 9.

Figure 10:
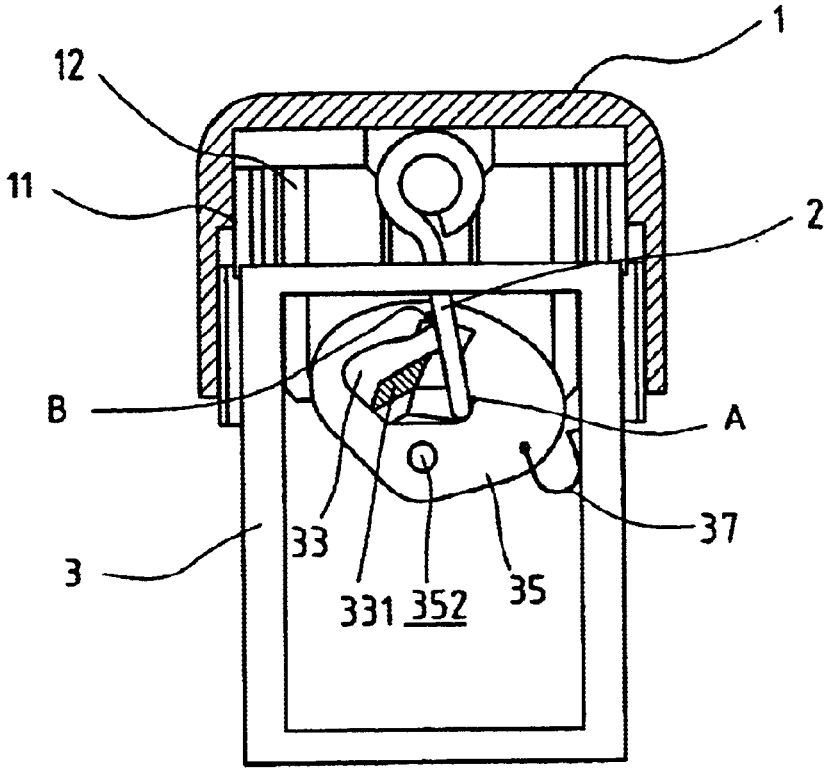
FIG. 10 is a schematic view showing that the positioning rod is released by the positioning disk and is ready to return to its original position.

When the user presses the button 1 again, the bent 22 forces the positioning disk 35 to pivot to the right. As the positioning rod 2 is pressed downwards, the bent 22 slides off the recessed channel 332 into a space by the side of the slanted face 331 as shown in FIG. 10. Consequently, the bent 22 is released from point (A) and thus the button 1 is pushed upward by the first resilient element 13. The bent 22 is then blocked in the positioning hole 351 near point (B), as shown in FIG. 7.

Another embodiment of the present invention is that the positioning rod 2 may be provided in the housing 3 and the positioning disk 35 and the passage 33 be formed in the button 1, which also accomplishes the pre-designed purpose.

Figure 11:
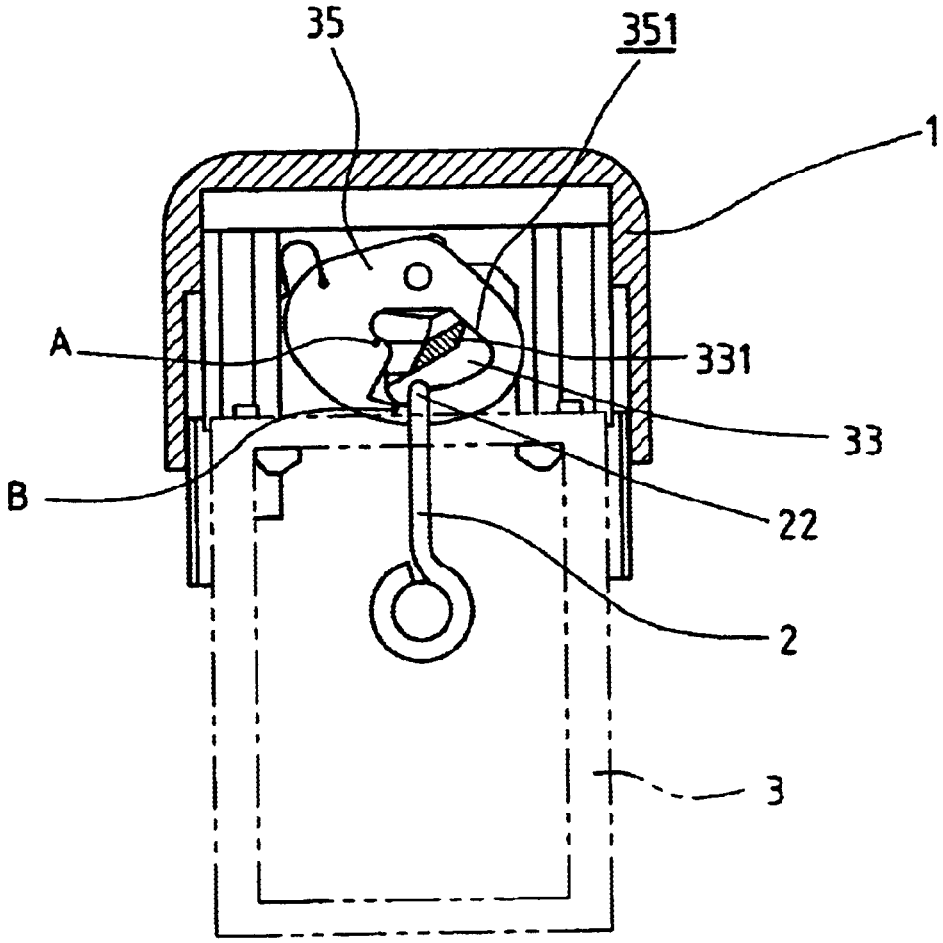
FIG. 11 is a schematic view of another embodiment of the present invention.

With reference to FIG. 11, the alternative embodiment of the present invention having the positioning rod 2 provided in the housing 3 and the positioning disk 35 and the passage 33 formed in the button 1 is shown. As can be seen in FIG. 11, the button 1 is formed with a projection which has a slanted face 331 formed in the bottom.

The positioning rod 2 is pivotally connected to the housing 3 by the second bolt 36 which extends through the second resilient element 24, the through hole 21 and into the assembly hole 141 of the assembly rod 14 that is formed inside the housing 3. After the assembly of the positioning rod 2, the bent 22 extends upward with respect to the housing 3.

The positioning disk 35 is pivotally connected to the button 1 by the first bolt 23 which extends through the first hole 352 of the positioning disk 35 and into the assembly slot 34 defined inside the button 1. The first resilient element 13 is still mounted inside the button 1 to be sandwiched between the button 1 and the housing 3 to provide a recovery force to the button 1 so that after the button 1 is pressed relative to the housing 3, the first resilient element 13 is able to push the button 1 back to its original position. When the assembly is finished, the bent 22 is received in the positioning hole 351 of the positioning disk 35.

Figure 12:
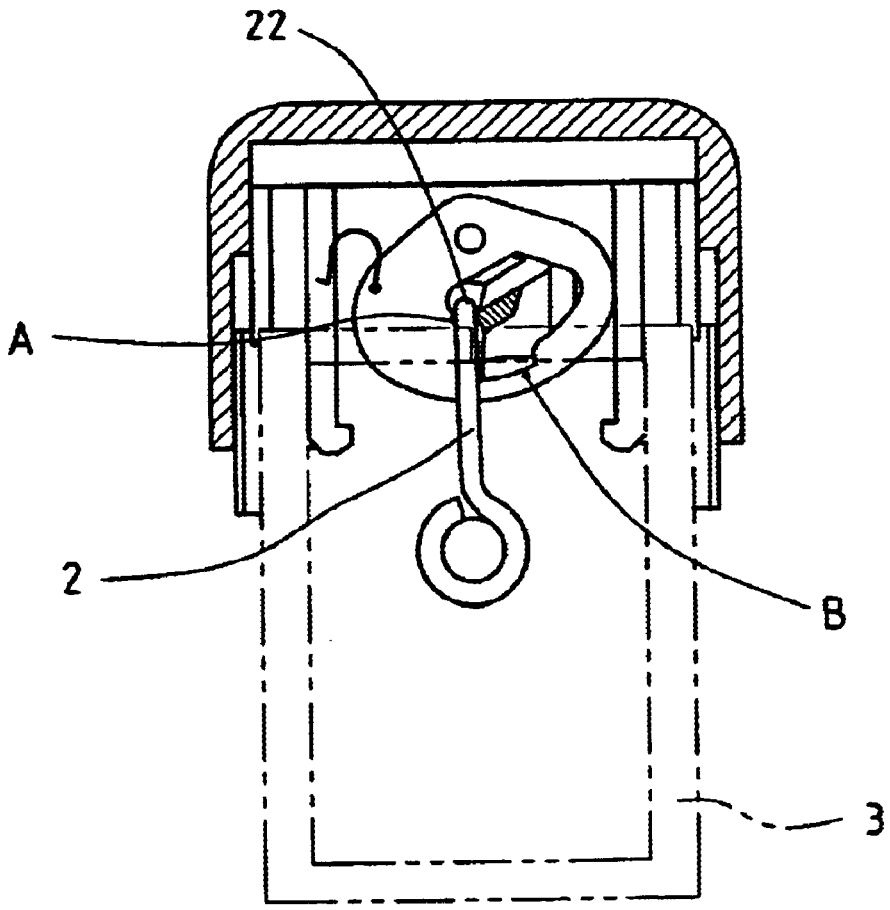
FIG. 12 is a schematic view showing the structure of the pushbutton assembly in FIG. 11 when the button is pressed.
Figure 13:
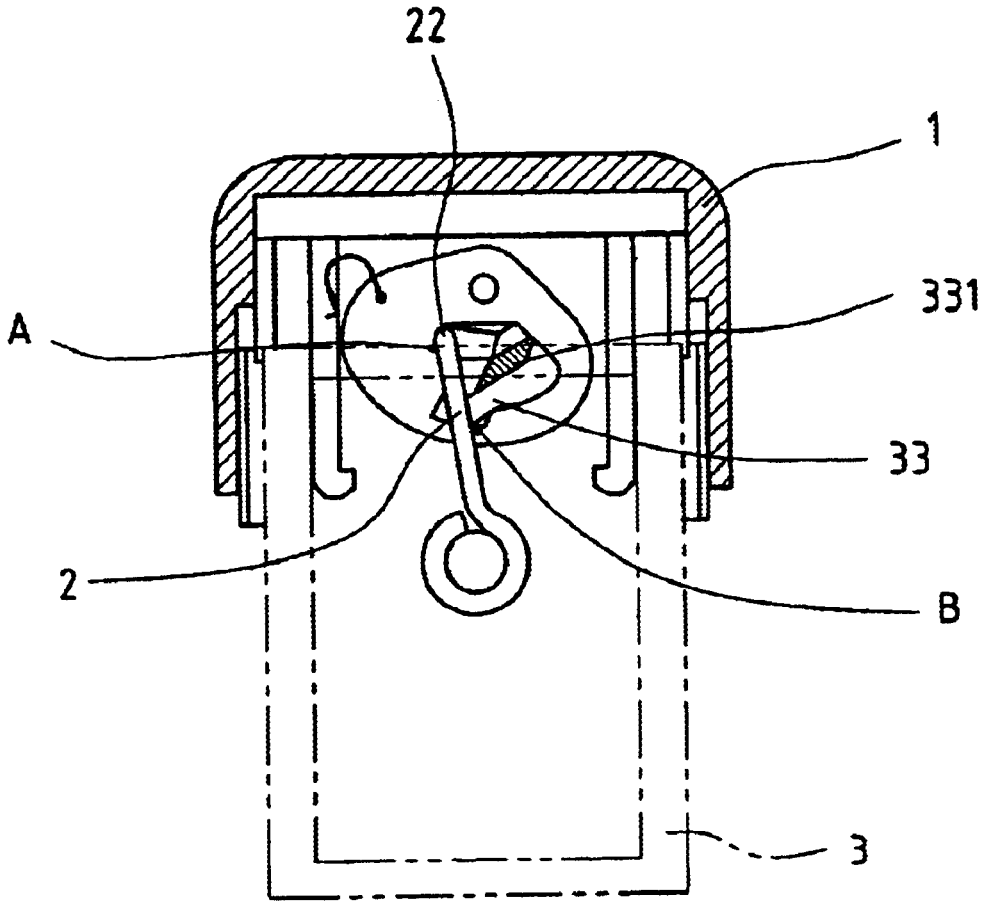
FIG. 13 is a schematic view showing that after the button of the embodiment in FIG. 11 is pressed, the positioning rod is positioned.

With reference to FIGS. 12 and 13, when the button 1 starts to move downward relative to the housing 3, the positioning disk 35 is driven to move accordingly. It should also be noted that in this embodiment, the recessed channel 332 shown in FIG. 5 becomes a recessed channel above the slanted face 331 in FIGS. 12 and 13. The bent 22 slides over the slanted face 331 in the passage 33, which allows the bent 22 to move to abut a side face defining the positioning hole 351 so that the positioning disk 35 pivots to the right. As the positioning disk 35 pivots to the right, the bent 22 slides into the recessed channel. If the user releases the button 1, the bent 22 rests in the recessed channel and is blocked near point (A) in the positioning hole 35l by the area near point (A) of the positioning disk 35 and the slanted face 331 as can be seen from FIG. 12 which shows that the button 1 is at a second (depressed) position. If the user presses the button 1 again, the bent 22 forces the positioning disk 35 to pivot to the left. As the positioning disk 5 pivots to the left, the bent 22 slides off the recessed channel into a space by the side of the slanted face 331 as shown in FIG. 13. Consequently, the bent 22 is released from point (A) and thus the button 1 is pushed upward by the first resilient element 13. The bent 22 is then blocked in the positioning hole 351 near point (B) and the pushbutton is returned to the position shown in FIG. 11.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A pushbutton assembly comprising:

a button;

a housing having a passage formed in the housing, a projection formed in the passage and a slanted face formed on the top of the projection;

a positioning disk disposed in front of the projection and pivotally connected to the housing, the positioning disk having a positioning hole formed through the positioning disk; and a positioning rod pivotally connected to the button, the positioning rod having a bent received in the passage through the positioning hole;

wherein movement of the button drives the bent to reciprocally move from a first position above the slanted face to a second position below the slanted face.

2. The pushbutton assembly as claimed in claim 1, wherein the button has at least one positioning hook corresponding to at least one hole in the housing for engaging the button with the housing.

3. The pushbutton assembly as claimed in claim 1, wherein the button has extensions and the housing has cutouts corresponding to the extensions for receiving the extensions.

4. The pushbutton assembly as claimed in claim 1, wherein a first resilient element is disposed between the button and the housing to push up the button.

5. The pushbutton as claimed in claim 4, wherein the first resilient element is a spring.

6. A pushbutton assembly comprising:

a button;

a housing having a passage formed in the housing, a projection formed in the passage and a slanted face formed on the top of the projection;

a positioning disk pivotally connected to the housing and having a positioning hole; and a positioning rod pivotally connected to the button, the positioning having a bent received in the passage through the positioning hole;

wherein the button has an assembly rod with an assembly hole and the positioning rod has a through hole defined to correspond to the assembly hole of the assembly rod for a first bolt to extend through the through hole of the positioning rod into the assembly hole of the assembly rod to pivotally connect the positioning rod to the button, and movement of the button drives the bent to reciprocally move from a first position to a second position.

7. The pushbutton as claimed in claim 6, further having a second resilient element sandwiched between the first bolt and the positioning rod.

8. The pushbutton assembly as claimed in claim 7, wherein the second resilient element is a spring.

9. The pushbutton assembly as claimed in claim 7, wherein the housing has an assembly slot and the positioning disk has a first hole defined to correspond to the assembly slot for a second bolt to extend through the first hole of the positioning disk and the assembly slot in the housing to pivotally connect the positioning disk to the housing.

10. A pushbutton assembly comprising:

a housing a button having a passage formed in the button, a projection formed in the passage and a slanted face formed on the bottom of the projection;

a positioning disk disposed in front of the projection and pivotally connected to the button, the positioning disk having a positioning hole formed through the positioning disk; and a positioning rod pivotally connected to the housing, the positioning rod having a bent received in the passage through the positioning hole;

wherein movement of the button drives the bent to reciprocally move from a first position below the slanted face to a second position above the slanted face.

11. The pushbutton assembly as claimed in claim 10, wherein the button has at least one positioning hook corresponding to at least one hole in the housing for engaging the button with the housing.

12. The pushbutton assembly as claimed in claim 10, wherein the button has extensions and the housing has cutouts corresponding to the extensions for receiving the extensions.

13. The pushbutton assembly as claimed in claim 10, wherein a first resilient element is disposed between the button and the housing to push up the button.

14. The pushbutton as claimed in claim 13, wherein the first resilient element is a spring.

15. A pushbutton assembly comprising:

a housing;

a button having a passage formed in the button, a projection formed in the passage and a slanted face formed on the bottom of the projection;

a positioning disk pivotally connected to the button and having a positioning hole; and a positioning rod pivotally connected to the button, the positioning rod having a bent received in the passage through the positioning hole;

wherein the housing has an assembly rod with an assembly hole and the positioning rod has a through hole defined to correspond to the assembly hole of the assembly rod for a first bolt to extend through the through hole of the positioning rod into the assembly hole of the assembly rod to pivotally connect the positioning rod to the housing, and movement of the button drives the bent to reciprocally move from a first position to a second position.

16. The pushbutton as claimed in claim 15, further having a second resilient element sandwiched between the first bolt and the positioning rod.

17. The pushbutton assembly as claimed in claim 16, wherein the second resilient element is a spring.

18. The pushbutton assembly as claimed in claim 16, wherein the button has an assembly slot and the positioning disk has a first hole defined to correspond to the assembly slot for a second bolt to extend through the first hole of the positioning disk and the assembly slot in the button to pivotally connect the positioning disk to the button.

* * * * *